US005823849A

United States Patent [19]

Gardner et al.

[11] Patent Number: 5,823,849

[45] Date of Patent: Oct. 20, 1998

[54] CIRCUIT WITH INTERMITTENT SENSING OF LIQUID CONTACT, AND GAME METHOD

[75] Inventors: Roger Gardner, Lomita; Elliot Rudell, Torrance, both of Calif.

[73] Assignee: Elliot A. Rudell, Torrance, Calif.

[21] Appl. No.: 808,337

[22] Filed: Feb. 28, 1997

[51] Int. Cl.[6] ..... A63B 67/00; F41J 5/044

[52] U.S. Cl. ..... 446/473; 273/349; 273/371; 273/373; 273/381; 340/604; 137/557

[58] Field of Search ..... 446/186, 473, 446/475; 273/349, 371, 373, 378, 381, 389; 200/81 R, 816, 81.9 R, 182, 185; 340/592, 604; 324/693; 374/174; 137/551, 554, 557; 116/264, 265; 204/220, 250, 251, 219; 422/68.1

[56] References Cited

U.S. PATENT DOCUMENTS

| | | | |
|---|---|---|---|
| 3,434,717 | 3/1969 | Schwartz | 273/349 |
| 4,077,629 | 3/1978 | Chestney | 273/101 |
| 4,223,894 | 9/1980 | Fabricant | 273/349 |
| 4,598,277 | 7/1986 | Feldman | 340/604 |
| 5,011,161 | 4/1991 | Galphin | 273/349 |
| 5,192,932 | 3/1993 | Schwab, Jr. | 340/604 |
| 5,411,269 | 5/1995 | Thomas | 273/349 |
| 5,573,243 | 11/1996 | Bartosik | 463/60 |

*Primary Examiner*—Robert A. Hafer
*Assistant Examiner*—Laura Fossum
*Attorney, Agent, or Firm*—Blakely Sokoloff Taylor & Zafman

[57] ABSTRACT

A toy that can sense contact with a fluid. The toy preferably contains a conductive member and an adjacent conductive screen. An indicator circuit has one terminal connected to the conductive member and another terminal connected to the conductive screen. The screen and conductive member are in relative close proximity so a fluid which flows through the screen will provide an electrically conductive path between the two conductive members. The conductive path closes the indicator circuit. The indicator circuit has an audio unit and/or light source that are activated when the circuit is closed by the fluid. The conductive members can be attached to a shield which also has a spray device. A player can spray another player with the spray device of the shield. The player can also block the spray of an opposing player with the shield. If the fluid makes contact with the conductive members the indicator circuit provides an indication that a "hit" has occurred. A player must therefore expose himself to a possible hit when attempting to spray another player. The toy may have a counter which shuts off the spray device if the player has been hit a certain number of times.

5 Claims, 3 Drawing Sheets

CIRCUIT WITH INTERMITTENT SENSING OF LIQUID CONTACT, AND GAME METHOD

BACKGROUND OF THE INVENTION

1. Field of the Invention

The present invention relates to a water toy that generates a sound and/or illuminates when the toy is struck by water.

2. Description of Related Art

There have been developed a number of water toys that allow players to squirt water at each other. For example U.S. application Ser. No. 08/573,369 filed in the name of Rudell discloses a water shield that has an integral pump and nozzle. The shield also contains a handle and a trigger which allow a player to squirt another player with water while utilizing the shield to block the water stream of the opposing player. The Rudell device can only be used to squirt water onto an opposing player. The Rudell shield does not provide a potential penalty for attempting to squirt another player. Additionally, the Rudell toy does not provide an indication of when a player has accurately squirted an opposing player. It would be desirable to provide a water emitting shield that provides an indication of when a player accurately squirted a stream of water.

There have been developed a number toys that will provide an audio indication when a fluid makes contact with a pair of electrical contacts. For example, there has been marketed a toy pend ant by the Panosh Group under the trademark AQUATECH wherein the device would emit a sound when water struck a pair of exposed metal surfaces of the device. The chances of simultaneously making contact with both conductive members were relatively low. Consequently, the toys had minimal appeal with the consumer because of the low probability of successfully operating the toy. Additionally, the user could spray another player without exposing his water sensor.

Tiger Electronics marketed a toy under the trademark BUBBLE BOPPER which emitted a sound when a player captured a bubble with a wand. Captoys, Inc. marketed a toy under the trademark MUSICAL BUBBLE TUNES wherein a player would create bubbles and try to capture the bubbles with a metal bar. The device would emit a sound when a bubble would make contact with two conductive bars. The toys described above typically contained two spaced apart metallic plates or bars, wherein the fluid would have to make simultaneous contact with both conductive members to close a circuit and create a sound. The toy devices of the prior art were sufficient to capture a bubble but would be inadequate to sense a stream of water.

SUMMARY OF THE INVENTION

The present invention is a toy that can sense contact with a fluid. The toy preferably contains a conductive member and an adjacent conductive screen. An indicator circuit has one terminal connected to the conductive member and another terminal connected to the conductive screen. The screen and conductive member are in relative close proximity so that a fluid which flows through the screen will provide an electrically conductive path between the two conductive members. The conductive path closes the indicator circuit. The indicator circuit has an audio unit and/or light source that are activated when the circuit is closed by the fluid. The conductive members can be attached to a shield which also has a spray device. A player can spray another player with the spray device of the shield. The player can also block the spray of an opposing player with the shield. If the fluid makes contact with the conductive members the indicator circuit provides an indication that a "hit" has occurred. A player must therefore expose himself to a possible hit when attempting to spray another player. The toy may have a counter which shuts off the spray device if the player has been hit a certain number of times.

DETAILED DESCRIPTION OF THE INVENTION

Figure 1:
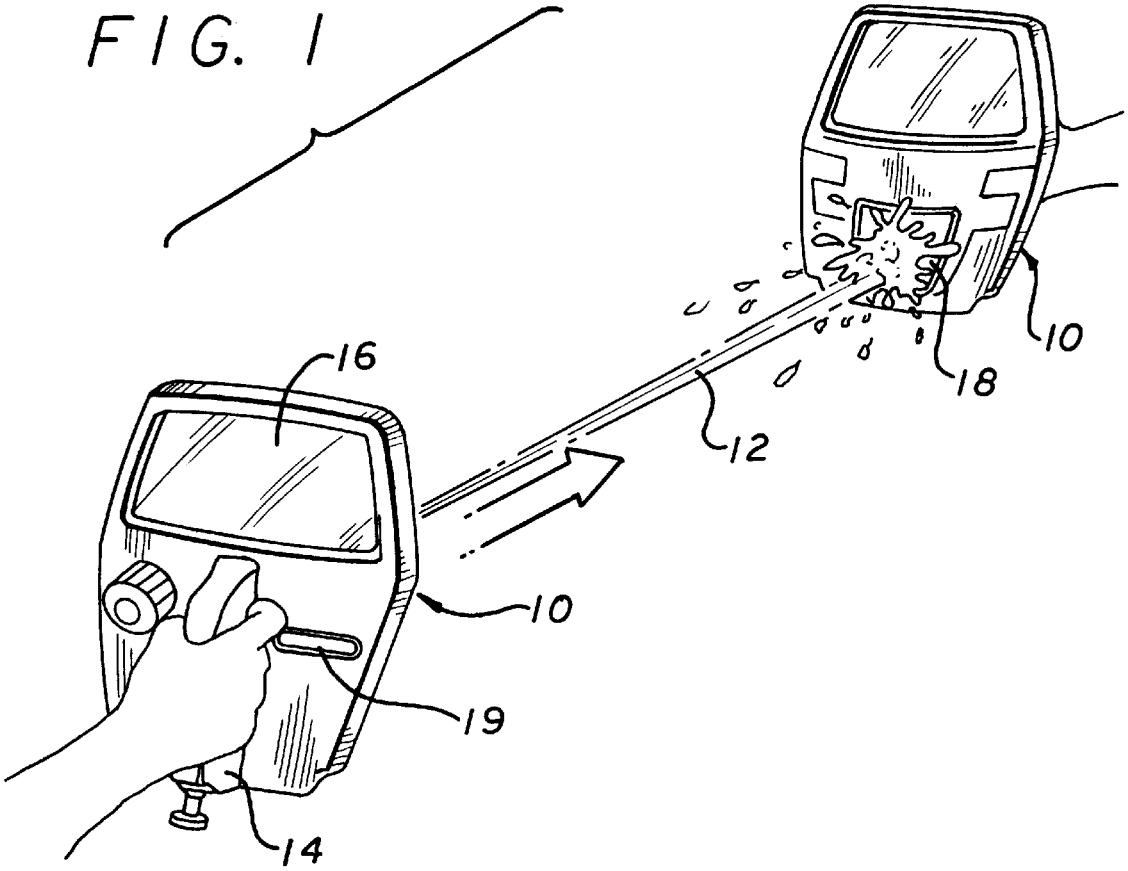
FIG. 1 is a perspective view of a pair of water sensing water spraying toy shields of the present invention.

Referring to the drawings more particularly by reference numbers, FIG. 1 shows a pair of water sensing water spraying toy shields 10 of the present invention. The shields 10 are held by opposing players. Each shield 10 has a spray device that emits a stream of fluid 12. The opposing player can block the fluid stream with his shield 10. The shields 10 each have a handle 14 that allows the player to hold the device 10 and a transparent window 16 so that the player can see through the shield 10.

Each shield 10 also has a fluid sensor 18 which provides an indication when the fluid strikes the sensor 18. The indication can be an audible sound generated by an internal audio unit. The shield 10 may also illuminate one of a plurality of light sources such as light emitting diodes (LEDs) 19.

The sensor 18 provides a target for an opposing player. The player must therefore manipulate the shield 10 to block an oncoming fluid stream without having the fluid strike the sensor 18. Additionally, the player must expose the shield 10 and target/sensor 18 when spraying an opposing player.

Figure 2:
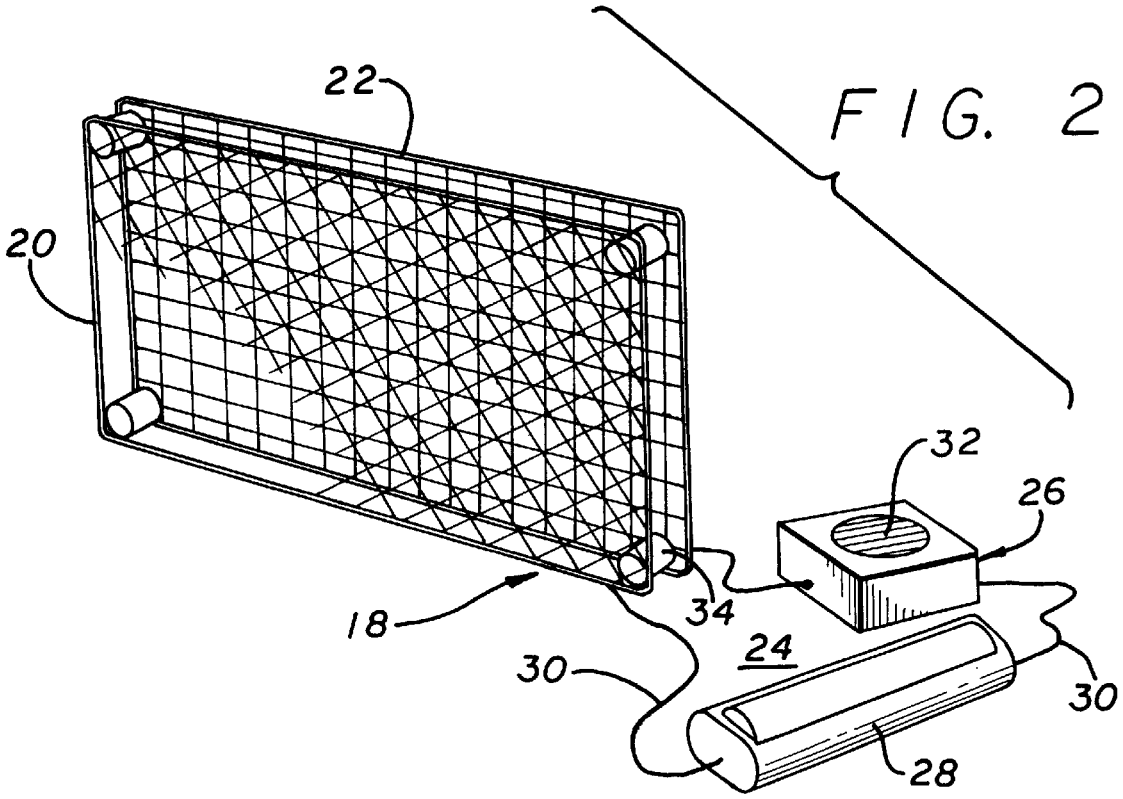
FIG. 2 is a perspective view of a fluid sensing circuit.

FIG. 2 shows a fluid sensor 18 connected to an indicator circuit 24. The sensor 18 includes an electrically conductive screen 20 that is adjacent to an electrically conductive member 22. The conductive screen 20 and member 22 are connected to an audio unit 26 and a power source 28 by wires 30. The audio unit 26 contains a speaker 32 and electrical circuitry (not shown) which generate sound when power is provided to the unit 26. The power source 28 is typically one or more DC batteries. The screen 20 and conductive member 22 are separated by dialectic spacers 34 which create an open circuit between the power source 28 and the audio unit 26. In the preferred embodiment, the conductive member 22 is also a screen, although it is to be understood that the member 22 can be a metal plate.

The screen 20 is located on the outer surface of a shield 10. Fluid flows through the screen 20 when a fluid stream strikes the sensor 18 of the shield 10. The fluid provides an electrical path between the screen 20 and the conductive member 22. The electrical path created by the fluid closes the circuit between the power source 28 and the audio unit 26. Power is provided to the audio unit 26 which generates an audible sound indicative of the fluid striking the sensor 18. Although the fluid sensor 18 is shown attached to a toy shield 10, it is to be understood that the sensor 18 can be implemented into any toy.

Figure 3:
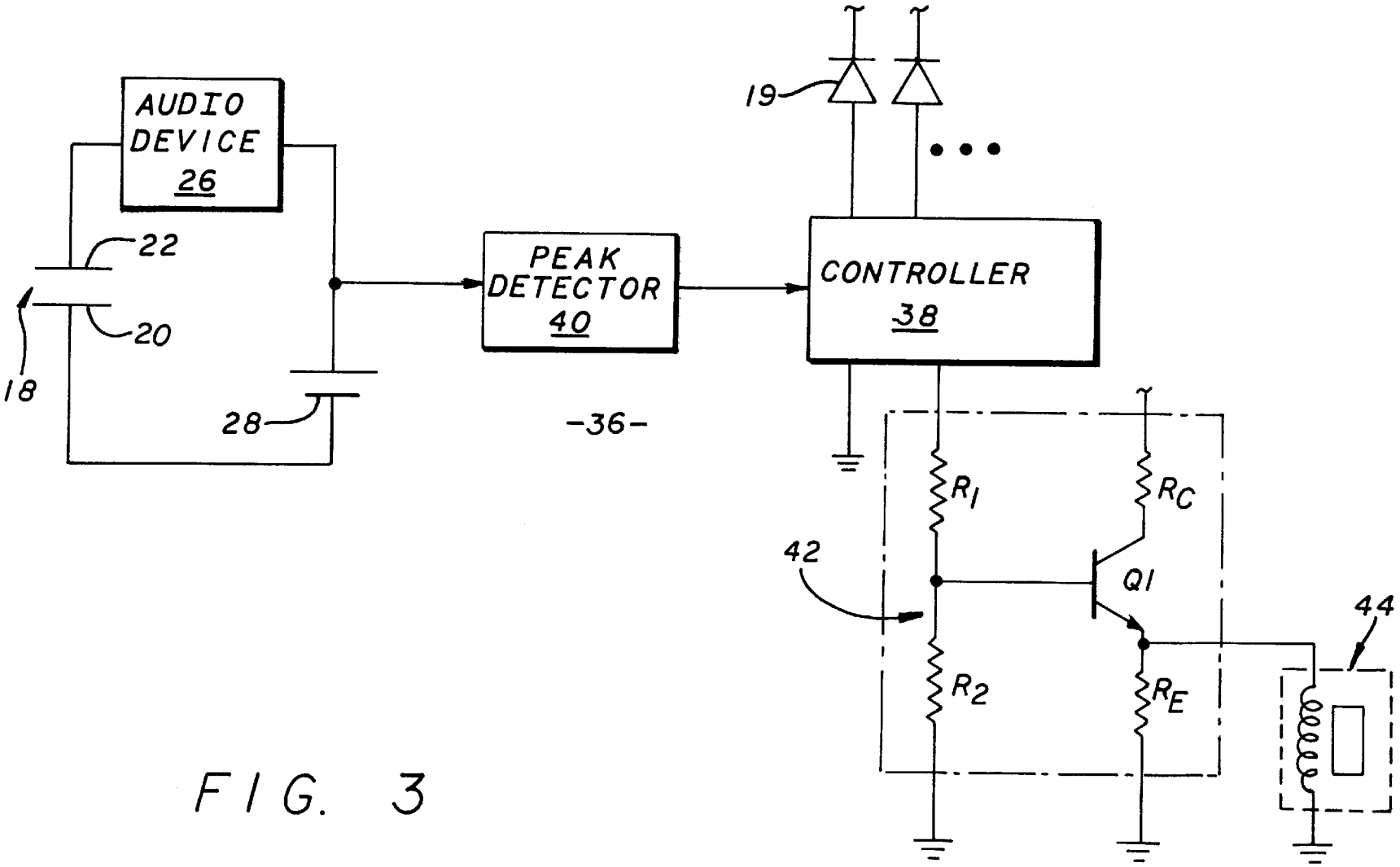
FIG. 3 is a schematic of an alternate embodiment of an electrical circuit of the shield.

FIG. 3 shows a fluid sensor 18 connected to another indicator circuit 36. The circuit 36 includes the power source 28 and audio unit 26 shown in FIG. 2. The sensor 18 may also be coupled to an electronic controller 38 by a peak detector 40. The peak detector 40 provides a digital input signal to the controller 38 each time fluid closes the circuit across the conductive members 20 and 22.

The controller 38 may have an internal counter which counts each time the fluid strikes the sensor 18. The controller 38 may be connected to the LEDs 19 to sequentially illuminate the diodes each time fluid strikes the sensor 18 and closes the circuit. The controller 38 may also provide an output signal to close an electronic switch 42 after a predetermined number of counts. The switch 42 may include a transistor Q1 and resistors $R_1$, $R_2$, $R_C$ and $R_E$. The switch 42 is coupled to a solenoid actuated normally open valve 44. The switch 42 closes the valve 44 and disengages the spray device of the shield so that the player cannot spray an opposing player. After a certain amount of time the controller 38 can open the valve 44.

In operation, a player squirts another player's shield to strike the sensor 18. Each time the sensor 18 is "hit" an LED 19 is illuminated and a sound is generated. After the player has hit the opposing sensor a certain number of times, the controller 38 within the opposing shield disengages the spray device so that the opposing player cannot spray the player.

Figure 4:
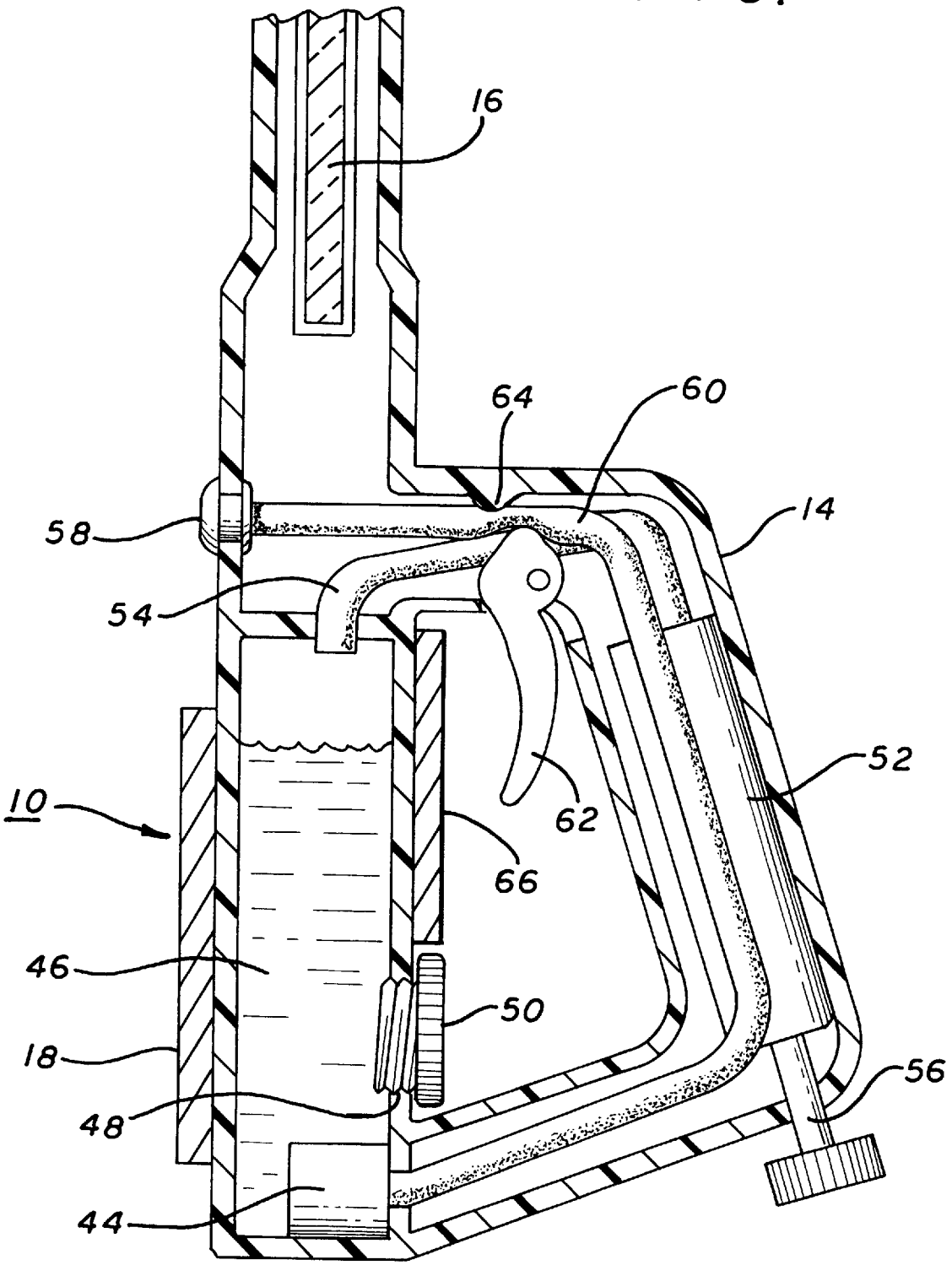
FIG. 4 is a cross-sectional view of the shield.

FIG. 4 shows a preferred embodiment of the spray device of the shield 10. The shield 10 includes a fluid reservoir 46 located within the shield 10. The end user can fill the reservoir 46 with water through a port 48 that is closed by a fill cap 50. The fluid reservoir 46 is coupled to a pump 52 by a tube 54. The pump 52 is preferably located within the handle 14 to minimize the size of the product. The pump 52 may have a piston 56 that can be manipulated to pressurize the water within the reservoir 46. Alternatively, the pump 52 may have an electric motor which pressurizes the water within the reservoir 46. As another alternate embodiment, the toy may have an internal flexible tube instead of the pump. The elastic properties of the tube exert a pressure on the water which will push the water out of the tube. Such a tube is disclosed in U.S. Pat. No. 5,173,175, which is hereby incorporated by reference.

The reservoir 46 is coupled to a nozzle 58 by another tube 60. The flow of water from the reservoir 46 to the nozzle 58 is controlled by a trigger 62. The trigger 62 pinches the tube 60 into an inner protrusion 64 of the handle 14 to prevent water from flowing into the nozzle 58. The trigger 62 can be rotated by the end user to open the tube 60 and allow water to flow out of the nozzle 58. The trigger 62 may have a spring (not shown) that normally biases the trigger 62 into the closed position. The nozzle 58 is preferably attached to the outer wall of the shield 10 so that the toy emits a water stream from the outer surface of the toy 10. The normally open solenoid actuated valve 44 may be located within the reservoir 46. The indicator circuit may be incorporated onto a printed circuit board assembly 66 that is attached to the shield 12.

The toy 10 can be operated by initially filling the reservoir 46 with water and then sliding the piston 56 in a reciprocating motion to pressurize the water. The end user can then depress the trigger 62 to allow the pressurized water to flow from the reservoir 46 to the nozzle 58. The end user can spray an opponent while deflecting water directed at the user. A sound is emitted and an LED is illuminated if the water strikes a sensor 18. The players spray each other until the controller 38 of one shield counts to a certain value and shuts off the spray device of the shield.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A toy that senses contact with a fluid, comprising:

a housing;

a spray device that is mounted on said housing and which emits a stream of fluid only in a direction away from the housing;

a conductive member that is attached to said housing;

a conductive screen that is adjacent to said conductive member so that fluid can flow through said conductive screen to said conductive member; and, an indicator circuit that is connected to said conductive member and said conductive screen, wherein said indicator circuit provides an indication of when fluid makes contact with said conductive member and said conductive screen.

2. The toy as recited in claim 1, wherein said conductive member is a screen.

3. The toy as recited in claim 1, wherein said indicator circuit includes an audio unit which generates an audible sound when the fluid makes contact with said conductive member and said conductive screen.

4. The toy as recited in claim 1, wherein said indicator circuit includes a light source that is illuminated when the fluid makes contact with said conductive member and said conductive screen.

5. The toy as recited in claim 4, wherein said indicator unit includes a controller that counts a number of times that the fluid makes contact with said conductive member and said conductive screen.

* * * * *